US009228774B1

(12) United States Patent
Keeling

(10) Patent No.: US 9,228,774 B1
(45) Date of Patent: Jan. 5, 2016

(54) CONCEALED MOUNT FOR REFRIGERATOR APPLIANCE DOOR PANEL

(71) Applicant: General Electric Company, Schenectady, NY (US)

(72) Inventor: Stewart Christopher Keeling, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/595,259

(22) Filed: Jan. 13, 2015

(51) Int. Cl.

| | |
|---|---|
| ***F25D 23/02*** | (2006.01) |
| ***F25D 23/06*** | (2006.01) |
| ***E06B 7/23*** | (2006.01) |
| ***E05B 1/00*** | (2006.01) |

(52) U.S. Cl.
CPC ..... *F25D 23/028* (2013.01); *E05B 1/00* (2013.01); *E06B 7/2305* (2013.01); *E06B 7/2314* (2013.01); *F25D 23/065* (2013.01)

(58) Field of Classification Search
CPC ... F25D 23/02; F25D 23/028; F25D 2223/02; E06B 7/22
See application file for complete search history.

(56) References Cited

U.S. PATENT DOCUMENTS

| | | | | |
|---|---|---|---|---|
| 5,471,709 | A * | 12/1995 | Lanzani | A47L 15/4261 16/238 |
| 7,665,810 | B2 | 2/2010 | Crompton et al. | |
| 7,770,985 | B2 * | 8/2010 | Davis | E06B 3/7001 312/204 |
| 8,020,949 | B2 | 9/2011 | Davis et al. | |
| 8,388,074 | B1 * | 3/2013 | Donberger | A47B 77/08 312/204 |
| 2009/0045705 | A1 * | 2/2009 | Laible | A47B 96/20 312/204 |
| 2009/0302723 | A1 * | 12/2009 | Laible | A47L 15/4265 312/237 |

FOREIGN PATENT DOCUMENTS

| | | |
|---|---|---|
| KR | 100861352 | 6/2004 |

* cited by examiner

*Primary Examiner* — Daniel Rohrhoff
(74) *Attorney, Agent, or Firm* — Dority & Manning, PA

(57) ABSTRACT

A refrigerator appliance and a door for a refrigerator appliance are provided. The refrigerator appliance includes features for firmly attaching a decorative panel to a door of the refrigerator appliance, where such features are hidden from the view of a user of the refrigerator appliance. The door for a refrigerator appliance includes concealed features for attaching a decorative panel to the door.

19 Claims, 3 Drawing Sheets

CONCEALED MOUNT FOR REFRIGERATOR APPLIANCE DOOR PANEL

FIELD OF THE INVENTION

The subject matter of the present disclosure relates generally to refrigerator appliances.

BACKGROUND OF THE INVENTION

Generally, refrigerator appliances include a cabinet that defines a fresh food chamber for receipt of food items for storage. Refrigerator appliances also usually include a door that, with normal operation, pivots about one or more hinges between an open and a closed position to allow access to the fresh food chamber. Many refrigerator appliances further include one or more freezer chambers for receipt of food items for freezing and storage, with a door positioned to selectively open or close the freezer chambers.

Some consumers may desire to customize the appearance of a refrigerator appliance, e.g., by providing one or more decorative panels as part of each door of the refrigerator. Such panels are typically mounted on the refrigerator appliance using one or more brackets positioned at the top and bottom of the door such that the brackets are hidden from the consumer's view. Thus, the sides of the panels are left unsupported, which, over time, may allow the panel to warp or creep. Additionally, a handle mounted to the panel is often provided for each door, to assist the consumer in opening and closing the door. Without supporting the sides of the panel, when a user pulls on the handle to open the door, the pulling force may cause the panel to flex, which could be undesirable in terms of how the panel appears and how the handle feels to the consumer.

Accordingly, improved refrigerator appliances are desired. In particular, a refrigerator appliance with features for firmly attaching a decorative panel to a door of the refrigerator appliance, where such features are hidden from the view of a user of the refrigerator appliance, would be advantageous. Additionally, a door for a refrigerator appliance with concealed features for attaching a decorative panel to the door would be beneficial.

BRIEF DESCRIPTION OF THE INVENTION

The present invention provides a refrigerator appliance and a door for a refrigerator appliance. The refrigerator appliance includes features for firmly attaching a decorative panel to a door of the refrigerator appliance, where such features are hidden from the view of a user of the refrigerator appliance. The door for a refrigerator appliance includes concealed features for attaching a decorative panel to the door. Additional aspects and advantages of the invention will be set forth in part in the following description, may be apparent from the description, or may be learned through practice of the invention.

In a first exemplary embodiment, a refrigerator appliance is provided. The refrigerator appliance includes at least one compartment for storing food items; and a door positioned at the opening of the compartment, the door being selectively adjustable between an open position and a closed position to permit selective access to the compartment. The door includes a shell including a panel portion and a trim portion the trim portion defining an opening; a panel including a decorative surface; and an insert. The insert has at least two side surfaces and a fastener surface, the side surface and the fastener surface defining a recess. The recess is positioned at the opening in the trim portion of the shell. The insert further includes a first surface positioned adjacent the panel portion of the shell, and the insert defines an aperture for receipt of a fastener configured to attach the panel to the shell.

In a second exemplary embodiment, a door for a refrigerator appliance is provided. The door includes a shell including a panel portion, a trim portion, a compartment portion, and a second trim portion. The panel portion, the trim portion, the compartment portion, and the second trim portion define a cavity, and the trim portion defines an opening. The door also includes a panel including a decorative surface and positioned adjacent the panel portion of the shell, and an insert positioned within the cavity of the shell. The insert includes at least two side surfaces and a fastener surface, the side surfaces and the fastener surface defining a recess; a first portion having a first surface, the first surface positioned adjacent the panel portion of the shell; and a second portion having a second surface. The recess is defined in the second portion, and the second surface is positioned adjacent the opening in the trim portion of the shell such that the recess is accessible through the opening. The insert also defines an aperture for receipt of a fastener configured to attach the panel to the shell.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
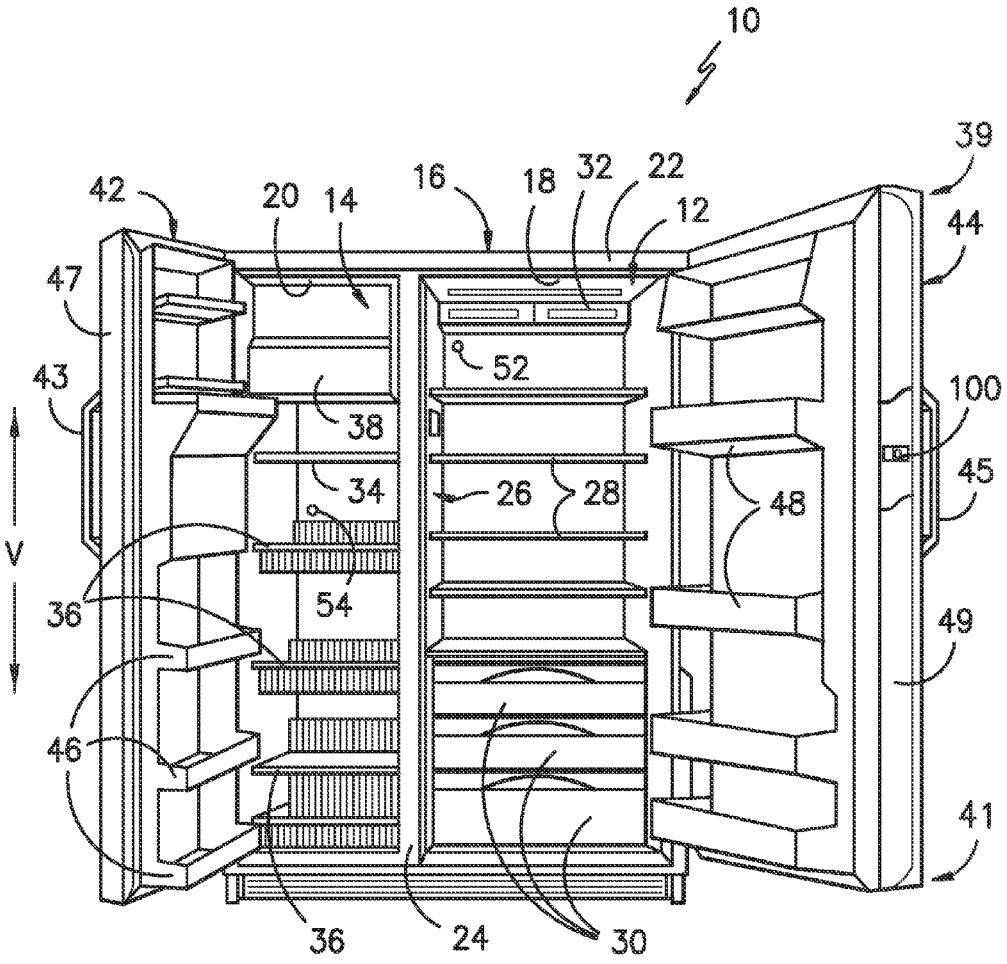
FIG. 1 provides a front view of a refrigerator appliance according to an exemplary embodiment of the present subject matter, with a portion of a trim piece of one door removed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a representative refrigerator appliance 10 in an exemplary embodiment of the present invention. More specifically, for illustrative purposes, the present invention is described with a refrigerator appliance 10 having a construction as shown and described further below. As used herein, a refrigerator appliance includes appliances such as a refrigerator/freezer combination, side-by-side, bottom mount, compact, and any other style or model of a refrigerator appliance. Accordingly, other configurations including multiple and different styled compartments could be used with refrigerator appliance 10, it being understood that the configuration shown in FIG. 1 is by way of example only.

Refrigerator appliance 10 includes a fresh food storage compartment 12 and a freezer storage compartment 14. Freezer compartment 14 and fresh food compartment 12 are arranged side-by-side within an outer case 16 and defined by inner liners 18 and 20 therein. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26. In addition, refrigerator appliance 10 includes shelves 28 and slide-out storage drawers 30, sometimes referred to as storage pans, which normally are provided in fresh food compartment 12 to support items being stored therein.

In one exemplary embodiment of the present invention, one or more temperature sensors are provided to measure the temperature in the fresh food compartment 12 and the temperature in the freezer compartment 14. For example, first temperature sensor 52 may be disposed in the fresh food compartment 12 and may measure the temperature in the fresh food compartment 12. Second temperature sensor 54 may be disposed in the freezer compartment 14 and may measure the temperature in the freezer compartment 14. This temperature information can be provided, e.g., a controller (not shown) for use in operating refrigerator 10. These temperature measurements may be taken intermittently or continuously during operation of the appliance and/or execution of a control system as further described below.

A shelf 34 and wire baskets 36 are also provided in freezer compartment 14. In addition, an ice maker 38 may be provided in freezer compartment 14. A freezer door 42 and a fresh food door 44 close access openings to freezer and fresh food compartments 14, 12, respectively. Using one or more hinges, each door 42, 44 is mounted to selectively rotate about its outer vertical edge between an open position, as shown in FIG. 1, and a closed position (not shown) to permit selective access to the associated storage compartment. In alternative embodiments, one or both doors 42, 44 may be slidable or otherwise movable between open and closed positions. A handle 43 mounted to door 42 and a handle 45 mounted to door 44 to assist a user with opening and closing doors 42, 44 to access compartments 14, 12. For example, a user can pull on handle 43 to open or close door 42 and access freezer compartment 14. Additionally, freezer door 42 includes a plurality of storage shelves 46, and fresh food door 44 includes a plurality of storage shelves 48.

Figure 2:
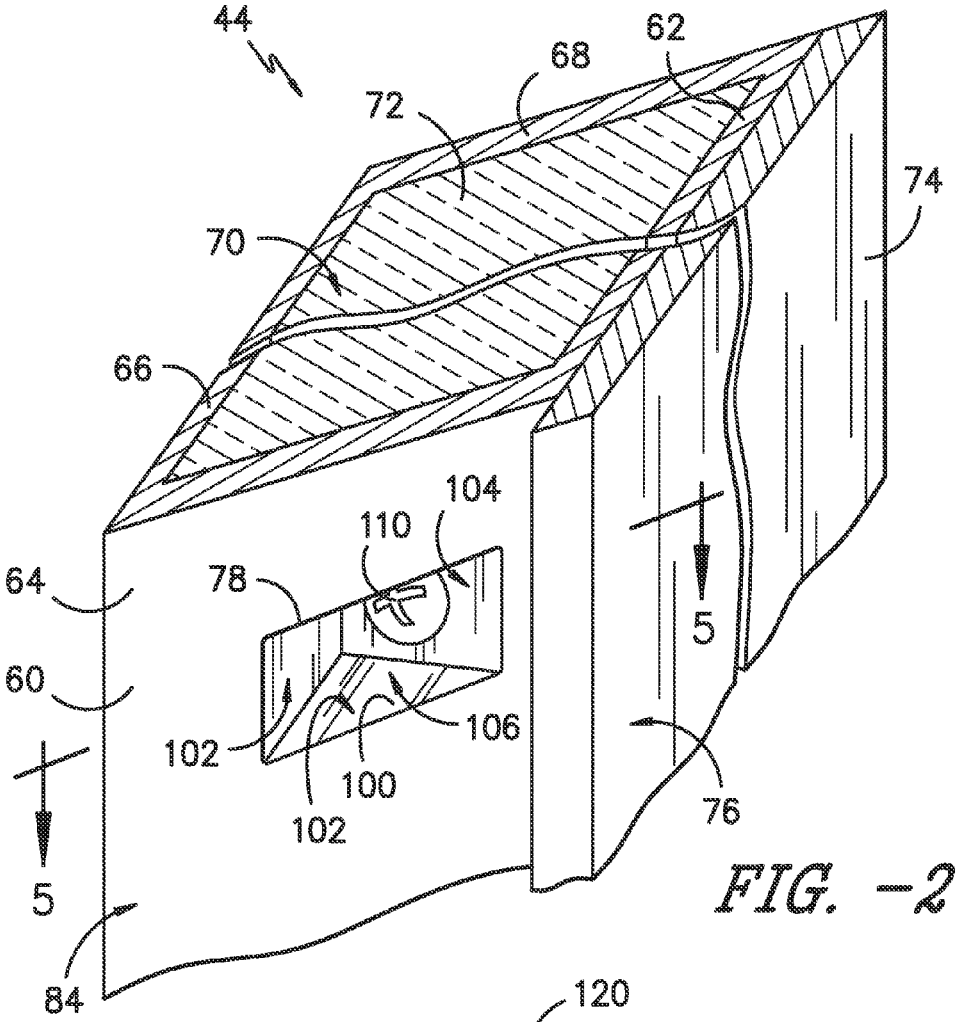
FIG. 2 provides an enlarged view of the portion of the door of the refrigerator appliance of FIG. 1 with the trim piece removed.

Referring now to FIG. 2, a partial cross-section view of door 44 is provided, with a trim piece 49 (FIG. 1) removed. As shown, door 44 includes a generally rectangular-shaped shell 60 having a panel portion 62, a trim portion 64, a compartment portion 66, and a second trim portion 68 opposite trim portion 64. Handle 45 may be positioned near trim portion 64, and the one or more hinges used to attach door 44 to refrigerator appliance 10 may be positioned near second trim portion 68. Panel portion 62, trim portion 64, compartment portion 66, and second trim portion 68 of shell 60 define a cavity 70. Cavity 70 of shell 60 is configured for receipt of an insulating material 72 to insulate door 44 and maintain an appropriate temperature within fresh food compartment 12. Insulating material 72 may be, e.g., a foam insulation that expands to fill cavity 70 of shell 60.

As illustrated in FIG. 2, a panel 74 is mounted to panel portion 62 of shell 60. Panel 74 includes a decorative surface 76 positioned such that it is visible to a user of refrigerator appliance 10. Panel 74 may be, e.g., a wooden panel crafted to coordinate with the décor of a kitchen in which refrigerator 10 is installed. For example, decorative surface 76 of panel 74 may match the style and/or configuration as a set of kitchen cabinets. Further, handle 45 may be mounted to or formed as part of panel 74. Other materials and configurations of panel 74 may also be used.

Trim portion 64 of shell 60 defines an opening 78, and an insert 100 is positioned proximate opening 78. Referring back to FIG. 1, opening 78 may be defined and insert 100 may be positioned at a location of trim portion 64 near handle 45, i.e., at a predetermined position spaced along a vertical direction V from a top portion 39 of door 44 and a bottom portion 41 of door 44. Additionally, as will be readily understood, more than one opening 78 and more than one insert 100 may be provided along trim portion 64 of shell 60.

Figure 3:
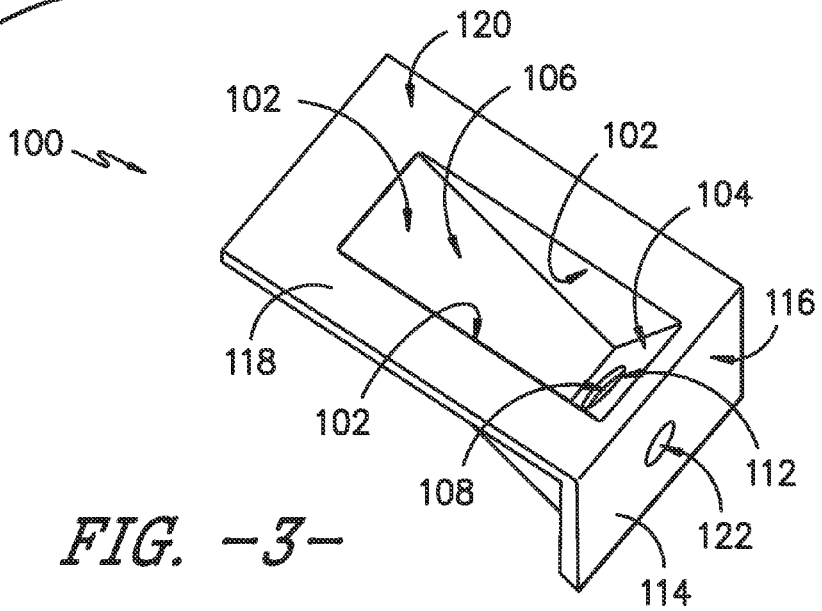
FIG. 3 provides a front, perspective view of an insert according to an exemplary embodiment of the present subject matter.

As shown in FIGS. 2 and 3, insert 100 includes at least two opposing side surfaces 102 and a fastener surface 104 therebetween defining a recess 106. In the illustrated embodiment, three side surfaces 102 and fastener surface 104 define recess 106. In other embodiments, two side surfaces 102 or more than three side surfaces 102 may be used with fastener surface 104 to define recess 106. Further, insert 100 defines an aperture 108 for receipt of a fastener 110 to attach panel 74 to panel portion 62 of shell 60. A first end 112 of aperture 108 is defined by fastener surface 104. As illustrated in FIG. 2, recess 106 is positioned adjacent opening 78 in trim portion 64 of shell 60 such that recess 106 and aperture 108 are accessible through opening 78. Although shown with one aperture 108 for receipt of a fastener 110, in other embodiments, insert 100 may define more than one aperture 108 for receipt of a fastener 110 such that more than one fastener 110 may be used in an insert 100 to attach panel 74 to shell 60. Fastener 110 may be any appropriate fastener, e.g., a screw or the like, or any suitable fastening mechanism.

Insert 100 also includes a first portion 114 having a first surface 116 and a second portion 118 having a second surface 120. First portion 114 extends orthogonally to second portion 118. As shown in FIG. 3, recess 106 is defined in second portion 118 such that second surface 120 surrounds recess 106. In addition, first surface 116 defines a second end 122 of aperture 108. Insert 100 may have other portions and surfaces as well.

Figure 4:
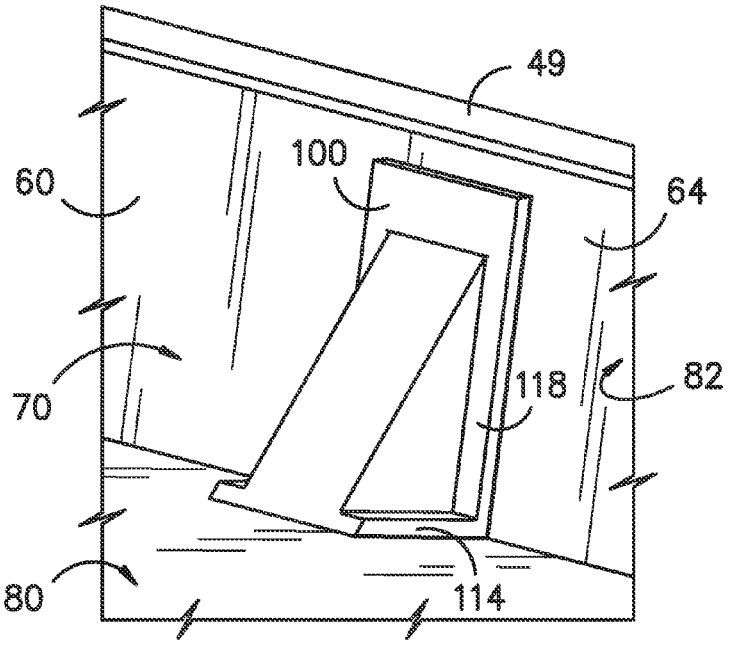
FIG. 4 provides a back, perspective view of the insert of FIG. 4, installed within a shell of the door of FIG. 2.
Figure 5:
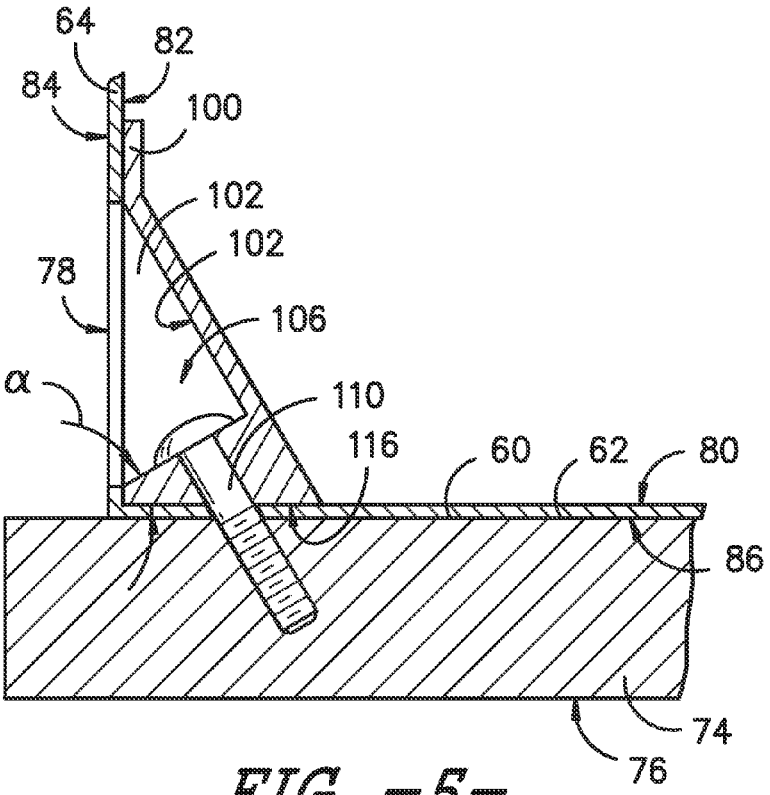
FIG. 5 provides a cross-section view taken along the line 5-5 of a portion of the door of FIG. 2.

FIGS. 4 and 5 illustrate insert 100 positioned within cavity 70 of shell 60 adjacent opening 78. First surface 116 of insert 100 is positioned adjacent inner surface 80 of panel portion 62 of shell 60. Second surface 120 of insert 100 is positioned adjacent inner surface 82 of trim portion 64 of shell 60. As shown in the exemplary embodiment, insert 100 may be generally wedge shaped such that insert 100 fits against both trim portion 64 and panel portion 62 of shell 60. In other embodiments, insert 100 may have any other appropriate shape or configuration.

An adhesive (not shown) may be applied at first surface 116 and/or second surface 120 to hold insert 100 in place. Additionally, insulating material 72 received within cavity 70 may keep insert 100 in place against panel portion 62 and trim portion 64 of shell 60. For example, if insulating material 72 is a foam insulation, the foam insulation may surround insert 100 such that insert 100 is foamed in place against shell 60.

As shown in FIG. 5, fastener 110 may be used to attach panel 74 to shell 60 of door 44. Panel 74 is attached to panel portion 62 of shell 60 adjacent an outer surface 86 of panel portion 62. Further, as illustrated, fastener surface 104 may be at a non-zero positive angle $\alpha$ with respect to first surface 116 of first portion 114 of insert 100 to facilitate insertion of fastener 110 into aperture 108. In one embodiment, angle $\alpha$ may be about 30°; in another embodiment, angle $\alpha$ may be about 45°. Any appropriate value for angle $\alpha$ may be used, but angle $\alpha$ generally may be any angle from approximately 0° to approximately 60°.

By providing aperture 108 for fastener 110 within recess 106 of insert 100, fastener 110 may be recessed such that fastener 110 is hidden or concealed from view and does not interfere with other components of door 44 and/or refrigerator appliance 10. As an example, by recessing fastener 110 within cavity 70 using insert 100, fastener 110 does not interfere with the opening or closing of door 44. Additionally, by providing insert 100 within cavity 70 of shell 60, one or more trim pieces, such as, e.g., trim piece 49, may be positioned over trim portion 64 of shell 60 to hide or conceal insert 100 and fastener 110 from the view of a user of refrigerator appliance 10. That is, insert 100 does not interfere with the installation of one or more trim pieces on or over trim portion 64. For example, trim piece 49 may be positioned adjacent an outer surface 84 of trim portion 64 to cover all of or a segment of trim portion 64, including opening 78 in trim portion 64 such that insert 100 and fastener 110 are concealed by trim piece 49. Further, by positioning first surface 116 of insert 100 against panel portion 62, fastener 110 may be driven into panel 74, e.g., near handle 45 of door 44, to firmly secure panel 74 to shell 60.

Door 44 having insert 100 is provided by way of example only. As described, more than one insert 100 may be included adjacent trim portion 64 of shell 60 for receipt of fasteners 110 for securing panel 74 to shell 60. In addition, second trim portion 68 may be configured similarly to trim portion 64. That is, second trim portion 68 may define one or more second openings, and an insert 100 may be positioned at each second opening. Also, it will be readily understood that door 42 may have a construction similar to door 44, employing one or more inserts 100 to secure a panel having a decorative surface to a shell to form door 42. Moreover, insert 100 may have any appropriate size, shape, and/or configuration for recessing one or more fasteners 110 such that fasteners 110 are hidden from view and do not interfere with other components of refrigerator appliance 10.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A refrigerator appliance, comprising:
at least one compartment for storing food items;
a door positioned at the opening of the compartment, the door being selectively adjustable between an open position and a closed position to permit selective access to the compartment, the door comprising
a shell including a panel portion and a trim portion the trim portion defining an opening;
a panel including a decorative surface; and
an insert including at least two side surfaces and a fastener surface, the side surface and the fastener surface defining a recess, the recess positioned at the opening in the trim portion of the shell, the insert further including a first surface positioned adjacent the panel portion of the shell,
wherein the insert defines an aperture for receipt of a fastener configured to attach the panel to the shell.

2. The refrigerator appliance of claim 1, wherein the trim portion of the shell comprises an inner surface and an outer surface, and wherein the insert is positioned adjacent the inner surface of the trim portion.

3. The refrigerator appliance of claim 1, wherein the shell further comprises a compartment portion and a second trim portion, and wherein the panel portion, the trim portion, the compartment portion, and the second trim portion define a cavity for receipt of an insulating material.

4. The refrigerator appliance of claim 3, wherein the insulating material is a foam insulation.

5. The refrigerator appliance of claim 3, wherein the insulating material holds the insert in place within the cavity of the shell.

6. The refrigerator appliance of claim 1, wherein the fastener surface is at a non-zero positive angle with respect to the first surface.

7. The refrigerator appliance of claim 1, wherein the door further comprises a handle connected to the panel, and wherein the insert is located near the handle.

8. The refrigerator appliance of claim 1, wherein the door comprises at least two inserts, each insert defining at least one aperture for receipt of a fastener to attach the panel to the shell.

9. The refrigerator appliance of claim 1, wherein the shell further comprises a second trim portion, the second trim portion defining a second opening, and wherein at least one insert is positioned at the second opening.

10. The refrigerator appliance of claim 1, wherein the decorative surface of the panel is positioned such that the decorative surface is visible to a user of the refrigerator appliance.

11. A door for a refrigerator appliance, comprising:
a shell including a panel portion, a trim portion, a compartment portion, and a second trim portion, the panel portion, the trim portion, the compartment portion, and the second trim portion defining a cavity, the trim portion defining an opening;

a panel including a decorative surface, the panel positioned adjacent the panel portion of the shell; and an insert positioned within the cavity of the shell, the insert comprising at least two side surfaces and a fastener surface, the side surfaces and the fastener surface defining a recess;

a first portion having a first surface, the first surface positioned adjacent the panel portion of the shell; and a second portion having a second surface, the recess defined in the second portion, the second surface positioned adjacent the opening in the trim portion of the shell such that the recess is accessible through the opening, wherein the insert defines an aperture for receipt of a fastener configured to attach the panel to the shell.

12. The door of claim 11, wherein the cavity is configured for receipt of an insulating material.

13. The door of claim 12, wherein the insulating material is a foam insulation.

14. The door of claim 12, wherein the insulating material holds the insert in place within the cavity of the shell.

15. The door of claim 11, wherein the fastener surface is at a non-zero positive angle with respect to the first surface.

16. The door of claim 11, further comprising a handle connected to the panel, and wherein the insert is located near the handle.

17. The door of claim 11, furthering comprising at least two inserts, each insert configured for receipt of at least one fastener.

18. The door of claim 11, wherein the decorative surface of the panel is positioned such that the decorative surface is visible to a user of the refrigerator appliance.

19. The door of claim 11, wherein the trim portion is covered with a trim piece such that the insert is not visible to a user of the refrigerator appliance.

* * * * *